US005664258A

United States Patent [19]

Harris

[11] Patent Number: 5,664,258

[45] Date of Patent: Sep. 9, 1997

[54] ANIMAL/FOWL CARICATURE-LIKE TOWEL PARKA

[75] Inventor: Robert Harris, Marlboro, N.J.

[73] Assignee: Hampton Industries, Inc., Kinston, N.C.

[21] Appl. No.: 695,417

[22] Filed: Aug. 12, 1996

[51] Int. Cl.[6] ..... A41D 3/08

[52] U.S. Cl. ..... 2/84; 2/69

[58] Field of Search ..... 2/84, 88, 69, 46, 2/102, 103, 104, 106, 115, 108, 1, 48, 49.1, 50, 51; D2/725, 733, 734, 735, 741, 745, 746, 776, 777, 825, 826, 831, 861, 862; D6/608, 609; 428/919

[56] References Cited

U.S. PATENT DOCUMENTS

| | | | |
|---|---|---|---|
| D. 182,645 | 4/1958 | Cetrulo . | |
| D. 196,096 | 8/1963 | Griffith et al. . | |
| D. 214,660 | 7/1969 | Szombathy . | |
| D. 285,815 | 9/1986 | Finn . | |
| D. 296,605 | 7/1988 | Asher . | |
| D. 362,106 | 9/1995 | Wauldron . | |
| 1,274,938 | 8/1918 | Rosenberg | 2/69 |
| 1,398,165 | 11/1921 | Whiteside . | |
| 1,432,249 | 10/1922 | Hoyme | 2/69 |
| 1,497,685 | 6/1924 | Hoyme | 2/69 |
| 1,603,501 | 10/1926 | Yenn . | |
| 1,895,911 | 10/1933 | Bosson, Jr. . | |
| 2,967,306 | 1/1961 | Fabanich . | |
| 3,013,274 | 12/1961 | Dike | 2/69 |
| 3,079,611 | 3/1963 | Boryszewski | 2/69 |
| 3,176,315 | 4/1965 | Freund | 2/69 |
| 3,323,136 | 6/1967 | Beck . | |
| 3,522,612 | 8/1970 | Palmer . | |
| 3,584,315 | 6/1971 | Hardy . | |
| 3,958,274 | 5/1976 | Klauber . | |
| 4,151,616 | 5/1979 | Larsen . | |
| 4,370,755 | 2/1983 | Crumby . | |
| 4,543,669 | 10/1985 | Katz | 2/84 |
| 4,594,735 | 6/1986 | Rolf et al. . | |
| 4,928,321 | 5/1990 | Dobson . | |
| 5,168,579 | 12/1992 | Marshall . | |
| 5,197,216 | 3/1993 | Norris | 428/919 |
| 5,206,958 | 5/1993 | Widenback . | |
| 5,459,881 | 10/1995 | Fagan et al. . | |

*Primary Examiner*—C. D. Crowder
*Assistant Examiner*—Gloria Hale
*Attorney, Agent, or Firm*—Diller, Ramik & Wight

[57] ABSTRACT

An animal/fowl caricature-like towel parka includes a conventional cotton pile towel folded immediately and slit along the fold to form a neck opening. A hood of pile material is sewn adjacent the neck opening and defines a face opening. The hood and/or conventional towel is provided with eyes, nose, ears, and feet of an animal and/or a fowl to create a caricature-like appearance of a particular animal or fowl.

4 Claims, 2 Drawing Sheets

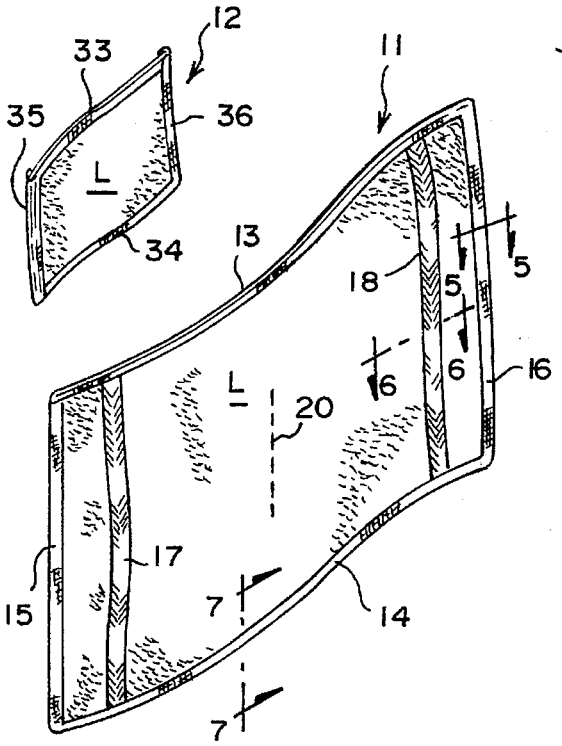
FIG. 4
FIG. 5
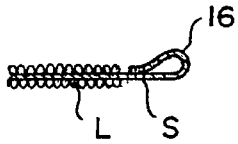
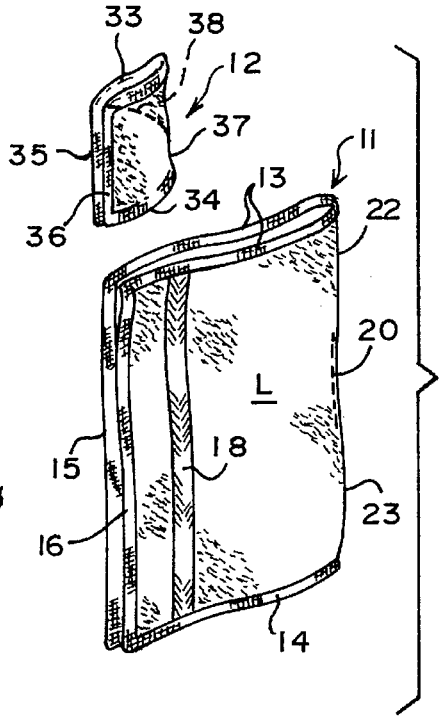
FIG. 8
FIG. 6
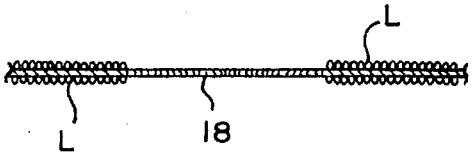
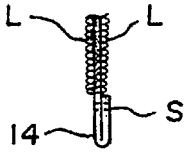
FIG. 7

ANIMAL/FOWL CARICATURE-LIKE TOWEL PARKA

BACKGROUND OF THE INVENTION

Conventional generally rectangular bath towels formed of cotton pile or cotton loop material have been utilized for wrapping therein and/or drying infants and small children for scores of years. Such towels are not only used to dry children but they are also "worn" at least temporarily for warmth, as can be readily observed at pools and/or beaches on cloudy and/or blustery days.

At times smaller children do not take kindly to being dried, and tend to resist efforts by adults to do so. Furthermore, the child has difficulty "wearing" a towel which tends to undrape from his or her body.

SUMMARY OF THE INVENTION

In keeping with the foregoing, a primary object of the present invention is to provide an animal/fowl caricature-like towel parka which by its very appearance generates a sense of interest and acceptance in a child and, therefore, a child is more like not to resist being dried-off by the fanciful towel parka which by its very appearance generates such a sense of interest and acceptance. Hence, a child is more likely not to resist being dried-off by the fanciful towel parka of the invention. Furthermore, since the towel parka is constructed as a "parka," it is readily retained upon the body of a child and will not inadvertently or accidentally slip therefrom.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 1 is a perspective view of a novel animal/fowl caricature-like towel parka or garment of the present invention, and illustrates a conventional cotton pile towel folded upon itself, slit to define a neck opening, and provided with a cotton pile hood sewn thereon forming a face opening with the hood carrying animal/fowl appendages, such as duck feet, a nose or beak, eyes, and the like.

FIG. 4 is an exploded view of a conventional cotton pile towel and a smaller conventional wash cloth or similar piece of cotton pile material, and illustrates the two major components of the towel parka of FIG. 1 prior to folding and assembly with the dash line of the towel indicating a portion of the towel which is to be slit therealong.

FIG. 5 is an enlarged cross-sectional view taken generally along line 5—5 of FIG. 4, and illustrates a conventional selvage edge folded and sewn upon itself.

FIG. 6 is an enlarged cross-sectional view taken generally along line 6—6 of FIG. 4, and illustrates a selvage interior band of the conventional towel.

FIG. 7 is an enlarged cross-sectional view taken generally along line 7—7 of FIG. 4, and also illustrates a selvage edge folded and sewn upon itself.

FIG. 8 is an exploded view of the towel and smaller piece of pile material, and illustrates each folded upon itself prior to being assembled to form the towel parka of FIG. 1.

DESCRIPTION OF THE PREFERRED EMBODIMENTS

Figure 1:
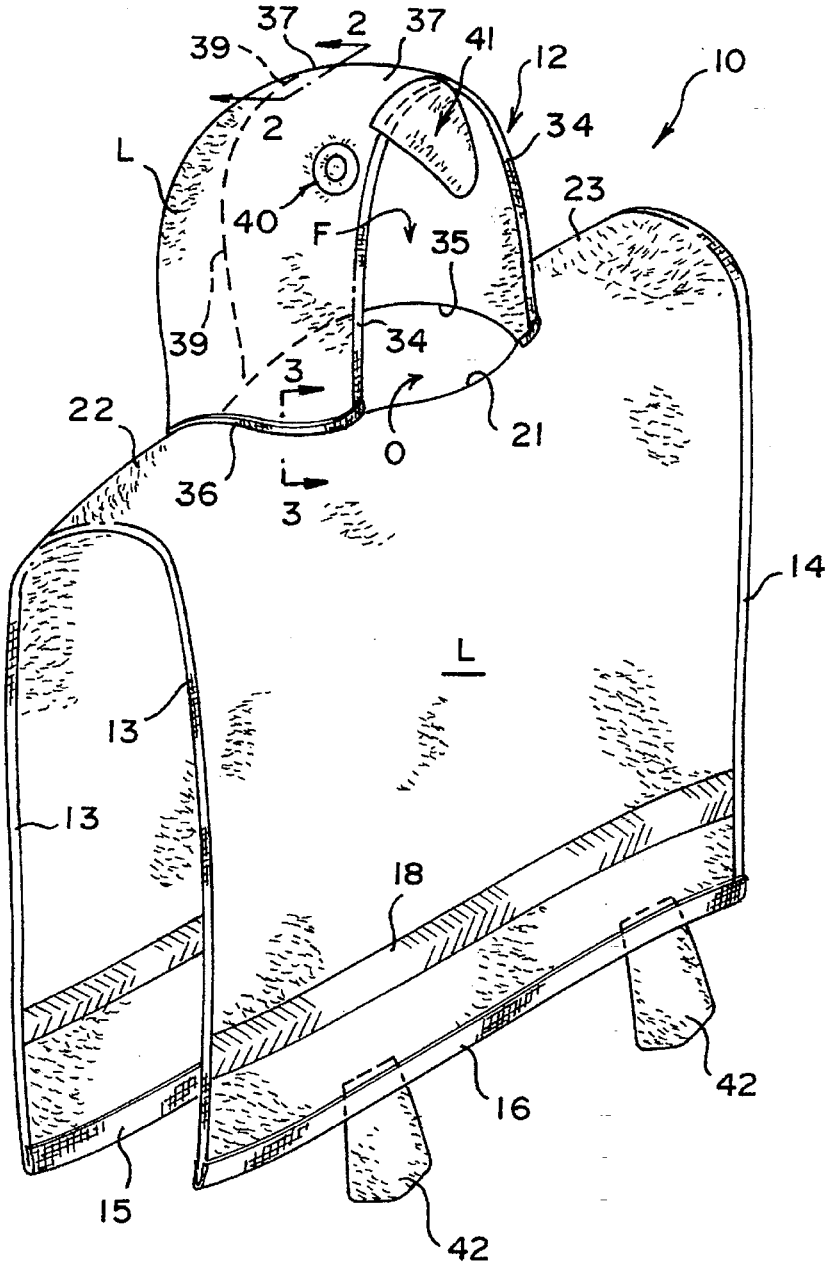
Figure 3:
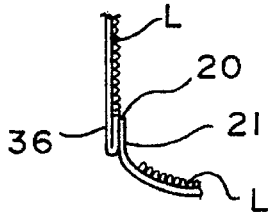
FIG. 3 is an enlarged cross-sectional view taken generally along line 3—3 of FIG. 1, and illustrates the manner in which a selvage edge of the hood and the towel opening are sewn together.

A novel animal/fowl caricature-like garment or towel parka constructed in accordance with this invention is fully illustrated in FIG. 1 of the drawings and is generally designated by the reference numeral 10.

The towel parka 10 is constructed from a conventional towel 11 (FIGS. 1, 4 and 8) and a smaller wash cloth or piece of cotton pile material defines a hood 12 (FIGS. 1, 4 and 8) thereof.

Referring to FIGS. 4 and 8 in particular, the conventional towel 11 of cotton pile or similar material is of a generally polygonal configuration, preferably rectangular, and includes generally parallel side edges 13, 14 and end edges 15, 16. The edges 13–16 are preferably selvage edges which prevent the relatively loose cotton pile loops or cotton pile knitted loops L (FIGS. 5, 6 and 7) from raveling. Each edge 13, 14, 15, 16 is folded upon itself, particularly as is illustrated in FIGS. 5 and 7 of the drawings, and is sewn by thread stitching S. Transverse bands 17, 18 are also formed as selvage, as is best illustrated in FIG. 6, with the bands 17, 18 being parallel to the edges 15, 16. In FIG. 4 a dashed line 20 illustrates the length and location of a cut line which is approximately midway between the edges 13, 14 and when cut, defines an edge 21 of an eventual neck opening or hole O (FIG. 1). The cut line 20 is essentially coincident or in alignment with folded portions, folds or shoulders 22, 23 which are shown rounded in FIG. 1 but define relatively flat fold lines aligned with the cut line 20 when the towel 11 is folded flat and with the edges 15, 16 in contacting relationship. This symmetry of the towel 11 permits the towel parka 10 to be folded into a relatively compact rectangular "package," just as in the case of a "conventional" towel absent the hood 12.

Figure 2:
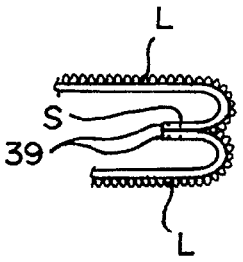
FIG. 2 is an enlarged cross-sectional view taken generally along line 2—2 of FIG. 1, and illustrates the details of the construction of the hood.

The hood 12 is likewise a small cotton pile or pile loop towel or a piece of pile material which is also of a generally polygonal configuration and includes a central area formed of cotton loops or piles L (FIGS. 4 and 8). Longitudinal selvage edges 33, 34 are overfolded and sewn to themselves by stitching S, as are similarly overfolded and stitched selvage edges 35, 36. The edges 35, 36 are brought into adjacent relationship with each other, as shown in FIG. 8, by simply folding the material midway along the fold line or fold portion 37. The overfolded piece of hood material of the hood 12 is then cut along an arcuate or curved cut line 38 defining cut edges 39 (FIG. 2) which are in-folded and sewn together by thread stitching S. The latter transforms the folded towel of FIG. 4 into the hood 12 of FIG. 1 which is sewn by stitching S between the edge 21 and the folded selvage edges 35, 36 which thereby defines a face opening F (FIG. 1) of the hood 12. Due to the curved configuration of the cut line 38 and the minor remaining portion of the fold 37, the hood 12 has a curved head-contoured appearance, as is readily apparent in FIG. 1. After sewing the edges 21, 35, 36 together, the edge 21 is also overfolded and sewn by stitching (not shown) to present a soft cotton pile edge most adjacent the opening O and the neck (not shown) of a child whose neck projects through the opening O and whose head is located within the hood 12 with his or her face looking outwardly through the face opening F.

In order to provide the animal/fowl caricature-like appearance to the towel parka 10, the same is provided with means carried by one or both of the body towel 11 (FIG. 11) and hood towel 12 (FIG. 8) or imparting an animal/fowl caricature-like appearance to the same, such as eye-defining means 40, only one being illustrated, beak or nose defining means 41 and webbed feet defining means 42, each being constructed from cotton pile loop material and being sewn by stitching (unnumbered) to the associated piece of towel material. Thus, the towel parka 10 of FIG. 1 provides the appearance of a caricature-like duck, but other animal/fowl appearances can be readily created. For example, rabbit "ears" formed from cotton pile material could be sewn into adjacent sides of the hood 12, a fluffy tail to the rear (unnumbered and not shown), and an appropriate "bunny" nose and feet substituted for the nose 41 and feet 42 of the towel parka 10 to impart thereto a bunny or rabbit-like caricature appearance. Thus, different animal/fowl caricatures can be created and a towel parka thereby selected to best correspond the towel parka 10 to the likes of the child who would utilize the same. For example, if a particular child likes a dog or a kitten, a dog towel parka or a kitten towel parka appropriately designed to define such an appearance could be purchased and utilized to lessen the sometimes difficult "bath time" involving infants and young children. Thus, a relatively young child will be less likely to resist bathing and, of course, when dried and thereafter wrapped in its favorite towel parka 10 feels warm, comfortable and loved.

Although a preferred embodiment of the invention has been specifically illustrated and described herein, it is to be understood that minor variations may be made in the apparatus without departing from the spirit and scope of the invention, as defined the appended claims.

What is claimed is:

1. An animal/fowl caricature towel parka comprising a body towel of pile material, said towel being of a generally polygonal configuration defined by opposite generally parallel side and end edges, selvage means along said edges for preventing raveling of said pile material, said towel being folded into substantially equal halves along a transverse fold portion with said end edges being in generally contiguous relationship to each other, said transverse fold portion being interrupted by a medial slit defining a neck opening, a hood of pile material corresponding to said towel pile material, said hood being defined by a single piece of pile material folded along a fold portion along a crown portion of the hood, an edge of said hood remote from said crown being sewn to said towel along said neck opening whereby a selvage edge of said single piece of pile material defines a face opening of said hood, and means attached to one of said towel and single piece for imparting an animal/fowl caricature appearance to said towel parka.

2. The animal/fowl caricature towel parka as defined in claim 1 wherein said imparting means including a pair of eyes upon said hood.

3. The animal/fowl caricature towel parka as defined in claim 1 wherein said imparting means includes a nose upon said hood.

4. The animal/fowl caricatures towel parka as defined in claim 1 wherein said imparting means including a pair of eyes and a nose upon said hood.

* * * * *